US005457449A

United States Patent [19]

Kuning et al.

[11] Patent Number: 5,457,449

[45] Date of Patent: Oct. 10, 1995

[54] METHOD AND APPARATUS FOR MONITORING HIGHWAY TRAFFIC

[75] Inventors: Mark J. Kuning; Thomas L. Phillips, both of Kelso, Wash.

[73] Assignee: Top Notch Manufacturing Company, Kelso, Wash.

[21] Appl. No.: 195,921

[22] Filed: Feb. 14, 1994

[51] Int. Cl.[6] ..... G03G 1/095

[52] U.S. Cl. ..... 340/908; 340/908.1; 340/905; 340/933; 340/940

[58] Field of Search ..... 340/908, 908.1, 340/905, 933, 940

[56] References Cited

U.S. PATENT DOCUMENTS 3,060,406 10/1962 Wright ..... 340/908
3,729,706 4/1973 Hein ..... 340/908

*Primary Examiner*—Donnie L. Crosland
*Attorney, Agent, or Firm*—Marger, Johnson, McCollom & Stolowitz

[57] ABSTRACT

A portable traffic warning device identifies hazardous traffic conditions at highway construction sites. The device includes an air hose that actuates a monitor switch whenever a vehicle travels over the air hose. A siren is operably coupled to the monitor switch and is capable of generating a high decibel audible alarm. A portable controller is coupled between the siren and the monitor switch and selectively couples power for preprogrammed amounts of time to the siren after the monitor switch is activated. A spool of retractable wire connects the monitor switch to the controller and allows the air hose to be placed at variable distances from the siren. A portable telescoping pole assembly is used for supporting the siren at variable vertical distances above the ground.

21 Claims, 3 Drawing Sheets

METHOD AND APPARATUS FOR MONITORING HIGHWAY TRAFFIC

BACKGROUND OF THE INVENTION

This invention relates generally to safety equipment for construction sites and more particularly to a portable highway traffic monitor.

Construction workers working on roadways are in constant danger of being hit by misguided traffic. For example, non-attentive drivers may not see a flagman or warning signs in front of a roadside construction site. The driver's vehicle can then run between safety barriers and injure workers at the construction site. Because loud heavy machinery is often used around a construction site, workers cannot hear approaching vehicles. Thus, the construction worker is unaware of approaching vehicles until the vehicle is too close to avoid.

U.S. Pat. No. 5,265,556 to Hall describes a traffic cone type device that activates a horn when knocked over. The horn in Hall, however, is integrally attached to the cone device. Because vehicular traffic often travels at high speeds, the device in Hall must be located well ahead of a construction site. For example, the device must be placed far enough in front of the construction site so that construction workers have ample time to avoid an approaching vehicle. Since the horn is located on the cone device, the horn is also located a significant distance from the construction site. With loud machinery, the distant sound from the horn is difficult to hear by construction workers.

The device in Hall is also fairly small. Thus, it is possible for a car to enter the construction zone without actually knocking over the safety device. Multiple devices would, therefore, have to be located in close proximity around the perimeter of the construction site for adequate safety protection. Multiple safety devices however would be expensive and time consuming to maintain. Further, since the safety device is self contained, it is subject to damage when run over by a vehicle. Thus, the device must be made from expensive impact resistent materials and parts must be constantly repaired or replaced each time the device is knocked over by a vehicle.

Accordingly, a need remains for a low cost traffic warning device that affectively monitors and indicates dangerous traffic conditions for wide areas around a construction site.

SUMMARY OF THE INVENTION

It is, therefore, an object of the invention to increase the effectiveness of identifying intruding vehicles at roadway construction sites.

Another object of the invention is to reduce the cost of traffic warning systems.

A further object of the invention is to increase safety at roadway construction sites.

A portable traffic warning device identifies hazardous traffic conditions at highway construction sites. The warning device is easily transported to different locations and provides traffic monitoring for wide areas around the perimeter of the construction site. The traffic warning device includes an elongated air hose that is laid down onto a road surface for identifying vehicles that trespass into the construction area. A monitor switch is pneumatically coupled to the air hose and actuates when a vehicle travels over the air hose. A siren is operably coupled to the monitor switch and is capable of generating a high decibel alarm. A portable controller is attached between the siren and the monitor switch and selectively couples power to the siren when the monitor switch is activated.

A spool of electrical cable connects the monitor switch to the controllers. The cable allows the air hose to be placed at variable distances from the siren. Thus, the siren can be placed close to the construction workers inside the construction site while the air hose remains around the perimeter of the construction site. A portable telescoping pole is used for supporting the siren at variable distances above the ground. The siren is joined to a cap that attaches over a top end of the telescoping pole. The telescoping pole also supports the controller. The telescoping pole is held upright by a set of detachable legs that extend laterally out from a bottom end of the pole.

The controller includes a rechargeable battery that activates the siren. An adapter is coupled to the battery and allows the battery to be recharged from a car cigarette lighter. The controller also includes a digital pulse timer that selectively varies the amount of time that the siren remains actuated after a vehicle runs over the air hose. The siren is automatically shut off after a predetermined amount of time to prevent construction workers from having to manually reset the traffic warning device. The controller is contained within a portable weather proof housing and is electrically coupled by plugs to both the siren and the monitor switch. A light flashes from the controller housing when the traffic warning device is turned on.

The air hose is laid down onto a road surface at a location on the outside perimeter of a construction site. The spool of electrical cable is then unwound so that the siren can be placed close to construction workers inside the construction site. The location of the siren inside the construction site and the decibel level of the alarm provide an easy to hear clearly identifiable warning of impending danger. Since the controller is also located inside the construction site, constructions workers can quickly enable or disable the warning device and verify that it is enabled.

The siren is moved to different locations within the construction area while the air tube remains positioned in the same location on the outside parameter of the construction site. The distance between the siren and the air hose is adjusted according to the speed limit for vehicular traffic on roadways around the construction area. For example, the siren and the air hose are distanced so that workers have ample time to avoid encroaching traffic. Because the telescoping pole places the siren at different distances above the ground, the siren can then be positioned above large trucks or other obstructions.

Thus, the warning device is lightweight, easy to install and operate and provides monitoring for a large roadway area. The siren is also separately transported to different sites in the construction area without having to move the air hose. Thus, less time is required to reposition the siren in new work areas. The only part of the device subject to collision with a vehicle is the air hose. Thus, replacement of parts is needed less frequently.

The foregoing and other objects, features and advantages of the invention will become more readily apparent from the following detailed description of a preferred embodiment of the invention which proceeds with reference to the accompanying drawings.

DETAILED DESCRIPTION

Figure 1:
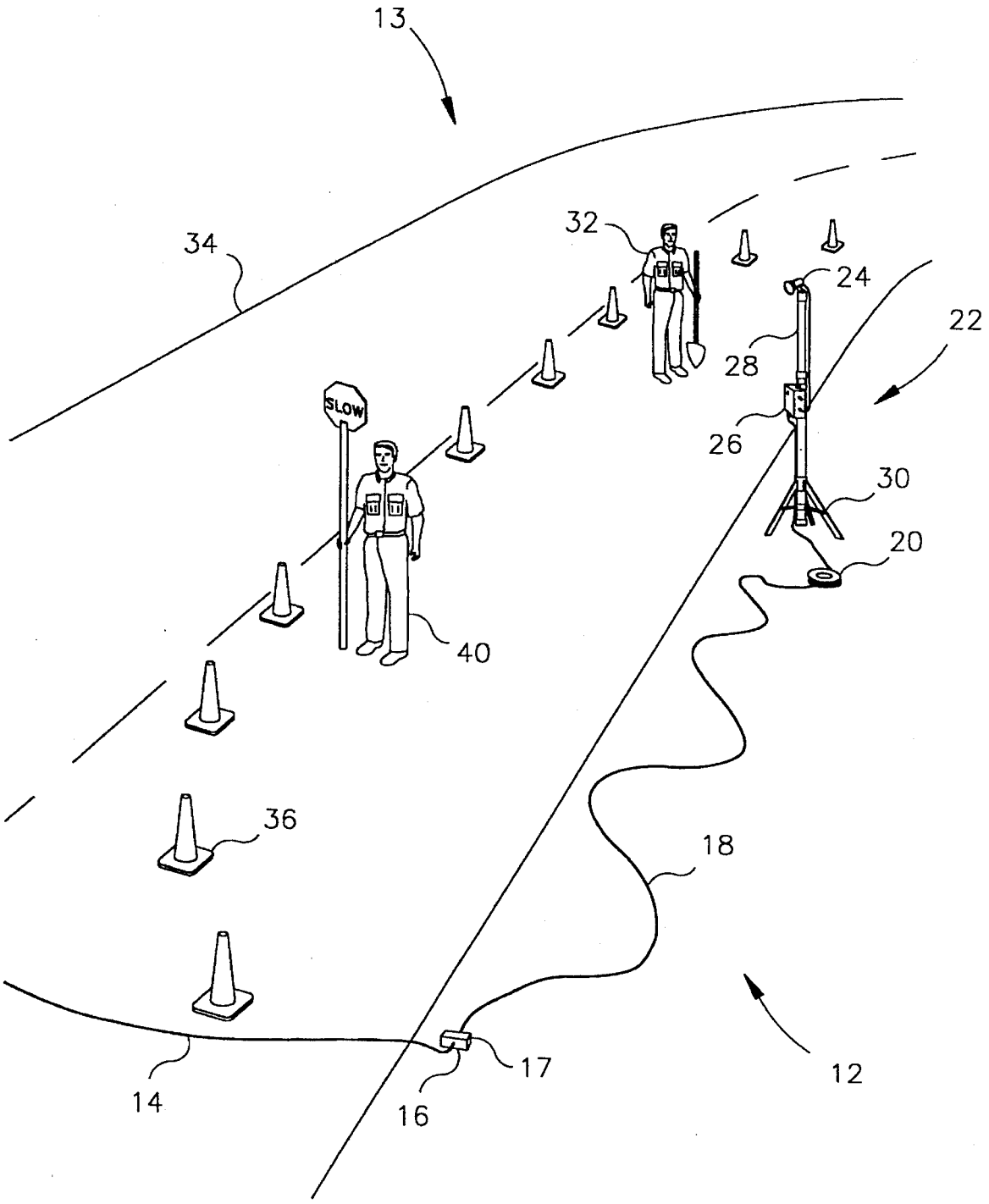
FIG. 1 is a perspective view of a traffic warning device according to the invention installed at a construction site.

FIG. 1 is a perspective view of a traffic warning device 12 according to the invention installed at a construction site 13. The traffic warning device 12 includes an elongated air hose 14 that is laid on a roadway 34. A monitor switch 16 located inside a weatherproof housing 17. The housing 17 is sealed to an end of the air hose 14. A spool 20 contains electrical cable 18. The cable 18 is coupled between the monitor switch 16 and a siren assembly 22. The siren assembly includes a telescoping pole 28 that supports a siren 24. A portable controller 26 is coupled between the siren 24 and the monitor switch 16. A set of retractable legs 30 are attached to a bottom end of pole 28.

Figure 2:
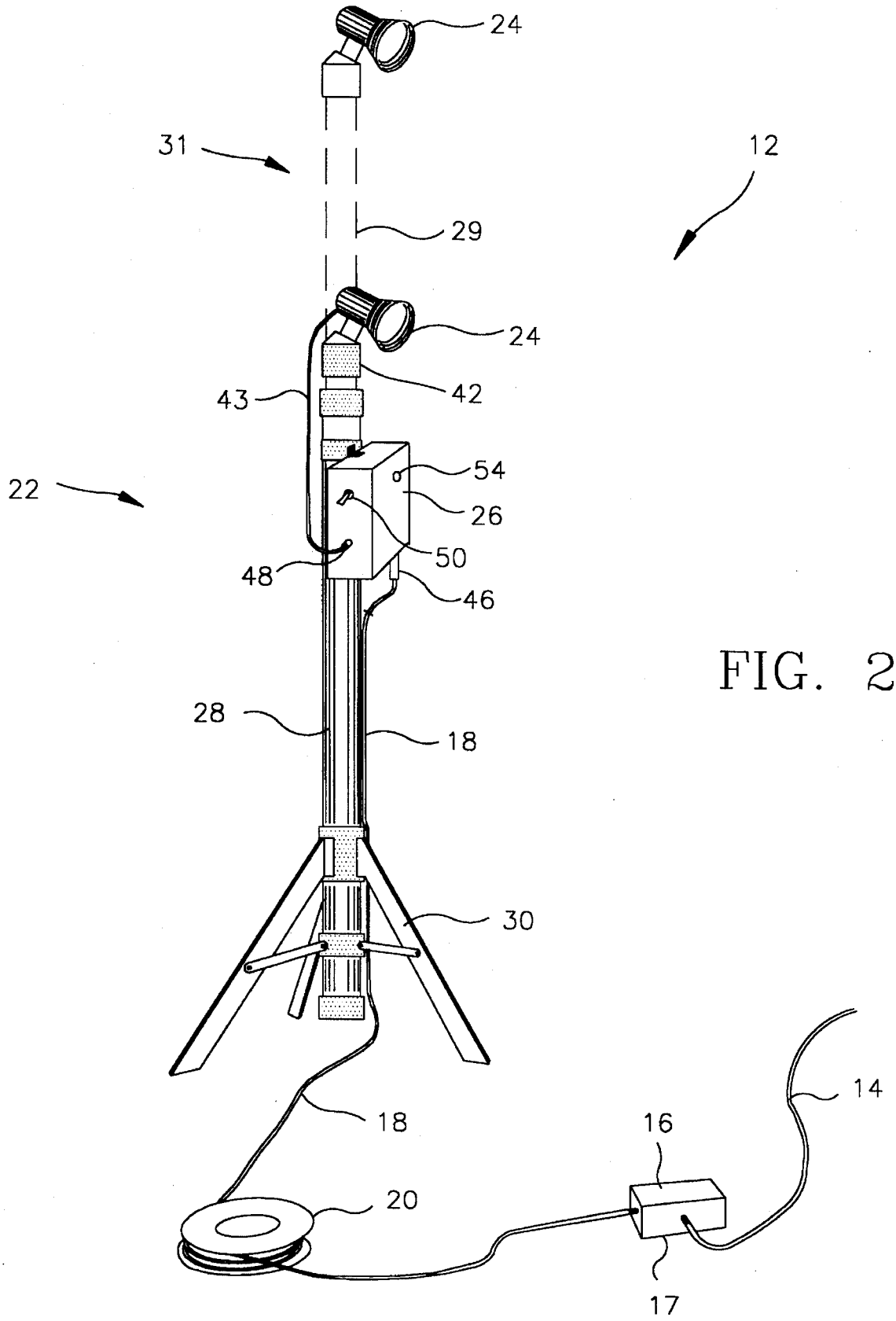
FIG. 2 is a detailed perspective view of the traffic warning device shown in FIG. 1.

FIG. 2 is a detailed perspective view of the traffic warning device 12 shown in FIG. 1. Siren 24 is joined to a cap 42 that attaches over a top end of an upper pole member 29. A cable 43 is electrically coupled between siren 24 and controller 26. Cable 43 has sufficient length to allow siren 24 to move from a lowered position to a raised position 31 shown in dashed lines. Controller 26 is attachable to pole 28 and receives an electrical plug 48 from the end of cable 43 and an electrical plug 46 from the end of cable 18. An on/off switch 50 extends from the side of controller 26 and a light emitting diode (LED) 54 extends out the front of controller 26. The retractable legs 30 are attached to a bottom end of pole 28 and support the siren assembly 22 vertically above the ground.

The air hose 14 is made from a flexible rubber tubing that can withstand constant compression from vehicular traffic. Air hose 14 is also flexible into various positions at each construction site. For example, air hose 14 can be placed in an "L" shape to monitor both the front and side parameter of the construction site. One end of the air hose is pneumatically sealed to the portable weather proof housing 17 that contains monitor switch 16. Monitor switch 16 comprises a pneumatically activated pressure sensitive switch that completes a contact from two wires in cable 18 when air pressure from air tube 14 is exhausted into housing 17. Pressure switches are well known to those skilled in the art and is, therefore, not shown in detail. The cable 18 allows the air hose 14 to be placed at variable distances from siren 24. Support structures other than telescoping pole 28 can be used to hold siren 24 above the ground. For example, siren 24 can be located on top of a car or truck. Sandbags can also be thrown over the top of legs 30 to further secure the siren assembly 22 in an upright position.

Figure 3:
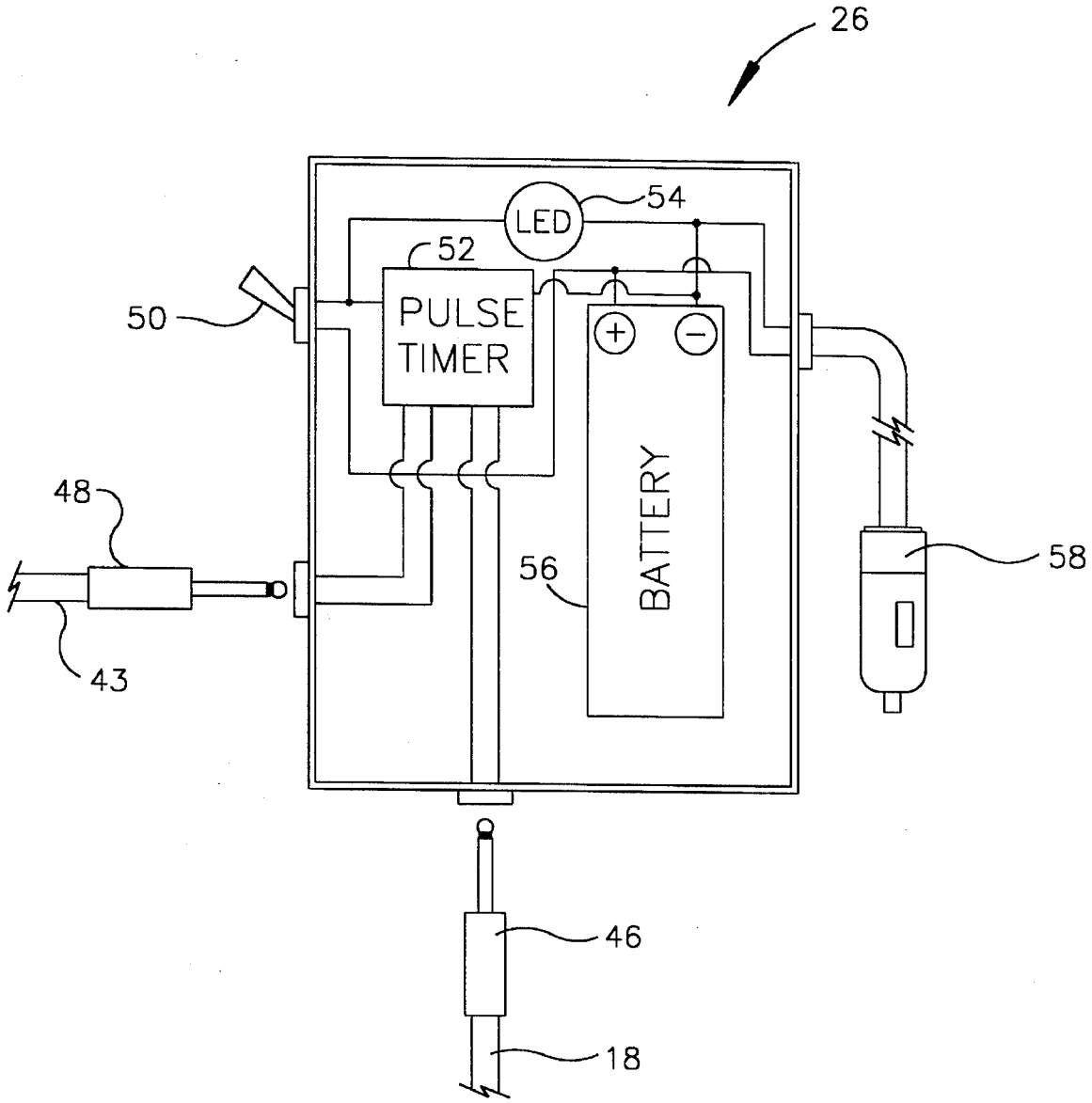
FIG. 3 is a detailed schematic of a controller used in the traffic warning device.

FIG. 3 is a detailed schematic of the controller 26 shown in FIG. 2. The controller 26 is contained inside a portable self contained weather proof housing 25. The controller 25 includes a rechargeable battery 56 coupled to LED 54 and a pulse timer 52 via switch 50. Cable 43 (FIG. 2) is connected by plug 48 to pulse timer 52 and cable 18 (FIG. 2) is connect by plug 46 to pulse timer 52. A low level monitoring circuit 57 activates a second LED 59 when the power level from battery 56 drops below a predetermined value. A plug 58 is coupled to the rechargeable battery 56 and is insertable into a car cigarette lighter. Alternatively, a 120 volt AC plug 61 is attached to battery 56 via an AC-DC converter 63. Thus, battery 56 is chargeable from a car battery or from an AC outlet.

Pulse timer 52 is a standard digital timing device such as a DEI 528T manufactured by Viper. Pulse timers are readily known to those skilled in the art and is, therefore, not described in detail. The rechargeable battery 56 can comprise any available rechargeable device such as nickel cadmium or liquid acid. The AC-DC converter 63 and low power level monitoring circuit 57 are standard off-the-shelf components known to those skilled in the art and are, therefore, not described in detail.

Referring to FIG. 1, the traffic alarm device operates in the following manner. The air hose 14 is placed on roadway 34 in a location where highway traffic would likely to accidentally enter into the construction area 13. For example, hose 14 is shown extending across an oncoming lane of the highway 34. IN the preferred embodiment, air hose 14 is approximately 20 feet long. The monitor switch 16 is laid down on the side of the highway and the electrical cable 18 rolled out so that siren 24 can be placed close to a construction worker 32.

In one embodiment cable 18 is approximately 300 feet long and allows the air hose 14 to be placed well in front of construction worker 32. After controller 26 is enabled, as described in detail below, any vehicle that runs over air hose 14 will pneumatically close the monitoring switch 16. The controller 26 receives a signal over cable 18 that will then activate siren 24 warning the construction worker 32 of the approaching vehicle.

The siren 24 is located a sufficient distance from air hose 14 to give the construction worker ample time to avoid the approaching vehicle. For example, if the construction is being performed on a highway with a 65 mile per hour speed limit, air hose 14 is placed further ahead of the construction worker 32. The construction worker then has more time to avoid approaching vehicles. On roadways with slower speed limits, the air hose 14 can be placed closer to the construction area and still give the construction worker 32 ample time to avoid vehicles that trespass into the construction site.

Because the siren is located away from the vehicle monitor (i.e., air hose 14), and located next to the construction worker 32, siren warnings are immediately and poignantly heard when a vehicle enters into the construction area. Sirens located on traffic monitors, for example, as shown in Hall, if placed too far from the construction site may not be clearly heard when heavy machinery is in operation.

Referring to FIG. 2, the traffic warning device 12 is completely portable for easy transport and installation at various construction sites. For example, the cap 42 attached to siren 24 is detachable from the top end of upper pole member 29. The controller 26 is also detachable from pole 28 so that battery 56 can be recharged as described below. The legs 30 are folded into a retracted position and detachable from the bottom end of pole 28 for easier storage.

Referring to FIG. 3, controller 26 is enabled when on/off switch 50 is closed. Power from battery 56 then enables pulse timer 52 and energizes LED 54. LED 54 begins flashing providing a visual indication that the traffic warning device 12 is enabled. If the power output from battery 56 falls below a given level, low level monitor 57 activates LED 59. LED 59 then begins flashing from the front of controller 26 (FIG. 2) notifying construction workers that battery 56 needs recharging.

When a vehicle compresses air hose 14 (FIG. 1), a negative pulse from cable 18 is latched by pulse timer 52. Pulse timer 52 then connects power from battery 56 to siren 24. The pulse timer 52 activates the siren 24 for a predetermined amount of time. For example, pulse timer 52 is programmable to activate the siren in a range of between 8 to 30 seconds. After the siren has been activated for the predetermined amount of time, pulse timer 52 automatically disconnects power from siren 24. This eliminates workers from having to manually reset or shut-off the traffic warning device 12 after a false trigger. For example, when a construction vehicle accidentally runs over air hose 14, the controller 26 automatically shuts off siren 24 after a preprogrammed amount of time. The pulse timer 52 then becomes automatically ready waiting for another activation signal from air hose 14.

Pulse timer 52 is also programmed to reset the siren activation periods when a second vehicle runs over air hose 14 while siren 24 is energized. For example, if a first vehicle runs over air hose 14, siren 24 will be activated for approximately 8 seconds. If a second vehicle runs over air hose 14 during the 8 second siren activation period, pulse timer 52 will keep siren 24 activated for another 8 seconds. Thus, construction workers are notified that additional vehicles may have entered into the construction site.

Electrical cables 43 and 18 are detachable from controller 26 by removing plugs 48 and 46, respectively. Controller 26 is then easily carried by itself inside a vehicle for recharging. Inside the vehicle, plug 58 is inserted into a cigarette lighter and battery 56 recharged. Alternatively, battery 56 is recharged by from an AC outlet using plug 61.

Having described and illustrated the principles of the invention in a preferred embodiment thereof, it should be apparent that the invention can be modified in arrangement and detail without departing from such principles. We claim all modifications and variation coming within the spirit and scope of the following claims.

We claim:

1. A portable device for identifying hazardous traffic conditions at highway construction sites, comprising:

an elongated pressure sensitive monitor for lying down onto a road surface;

a monitor switch coupled to the monitor, the switch actuating when a predetermined amount of pressure is applied onto the monitor;

a siren operably coupled to the monitor switch, the siren generating a high decibel alarm when energized; and a portable controller coupled between the siren and the monitor switch for selectively energizing the siren for a given amount of time after the monitor switch is actuated, the controller further including means for both selectively varying the amount of time that the siren remains energized after the monitor switch is actuated and extending energization of the siren by the selected amount of time when the monitor switch is reactuated during siren energization.

2. A device according to claim 1 wherein the monitor comprises a flexible air hose sealed to a pneumatically actuated contact switch.

3. A device according to claim 2 wherein the air hose comprises flexible rubber tubing movable into various orientations at different locations at the construction site while the siren remains in the same location.

4. A device according to claim 2 including a portable weather resistent housing that contains the monitor switch, the housing pneumatically sealed to a first end of the air hose and transportable along with the air hose to different construction site locations.

5. A device according to claim 1 including a spool of retractable electrical cable connected at a first end to the monitor switch and connected at a second end to the controller, the spool of cable allowing the monitor to be placed at variable distances from the controller.

6. A device according to claim 1 including a portable telescoping pole for supporting the siren at variable vertical distances above the ground.

7. A device according to claim 6 including a cap attached to the siren and detachably coupled to a top end of the telescoping pole.

8. A device according to claim 6 including detachable legs joined to a bottom end of the telescoping pole for supporting the telescoping pole in a vertical position.

9. A device according to claim 6 wherein the controller includes a rechargeable battery for energizing the siren.

10. A device according to claim 9 including an adapter coupled to the rechargeable battery insertable into a car cigarette lighter.

11. A device according to claim 1 wherein the controller includes means for selectively varying the amount of time that the siren is actuated after the predetermined amount of pressure has been applied to the monitor.

12. A device according to claim 1 wherein the controller is contained within a portable weather proof housing that is electrically coupled by plugs to both the siren and the monitor.

13. A device according to claim 12 including a visual indicator extending from the housing for indicating that the controller is activated.

14. A method for identifying dangerous safety conditions from vehicular traffic at a roadway construction site, comprising:

lying a pressure sensitive monitor on the ground at an outside perimeter location of a construction site;

connecting a siren to the monitor for generating a high decibel level alarm;

locating the siren inside the perimeter of the construction site while the monitor remains at the outside perimeter location, the siren location and the decibel level of the alarm allowing the alarm to be easily heard by workers inside the construction site;

activating the siren for a given amount of time responsive to a vehicle running over the monitor; and extending activation of the siren by said given amount of time when the monitor switch is reactuated during siren energization.

15. A method according to claim 14 including transporting the siren and monitor to different construction sites and varying the distance between the siren and the monitor according to the speed of vehicular traffic around the construction site and the size of the construction site.

16. A method according to claim 14 including controlling the amount of time that the alarm is activated after a vehicle runs over the monitor.

17. A method according to claim 14 including visually indicating that the monitor is actively monitoring vehicular traffic.

18. A method according to claim 14 including supporting the siren at variable vertical distances above the ground.

19. A method according to claim 14 including providing a portable battery for energizing the siren and recharging the battery by attaching the battery to a car cigarette lighter.

20. A portable system for identifying hazardous traffic conditions at highway construction sites, comprising:

an elongated pressure sensitive air hose for lying down onto a road surface;

a pneumatically actuated switch coupled to the air hose, the switch actuated when a predetermined amount of force compresses the air hose;

a spool of electrical cable joined at a first end to the switch;

a siren operably coupled to a second end of the wire for generating a high decibel alarm audible over heavy machinery;

a portable controller coupled between the siren and the switch for selectively coupling power to the siren for a given amount of time according to the actuation condition of the monitor switch; and extending activation of the siren by said given amount of time when the monitor switch is reactuated during siren energization.

21. A system according to claim 20 including a portable stand for holding the siren and power supply controller above the ground.

* * * * *